US006008785A

United States Patent [19]

Hewlett et al.

[11] Patent Number: 6,008,785

[45] Date of Patent: Dec. 28, 1999

[54] GENERATING LOAD/RESET SEQUENCES FOR SPATIAL LIGHT MODULATOR

[75] Inventors: Gregory J. Hewlett, Garland; Donald B. Doherty, Richardson, both of Tex.

[73] Assignee: Texas Instruments Incorporated, Dallas, Tex.

[21] Appl. No.: 08/975,377

[22] Filed: Nov. 20, 1997

[51] Int. Cl.[6] ..... G09G 3/34

[52] U.S. Cl. ..... 345/85; 345/48; 345/84; 345/108; 345/148; 349/25

[58] Field of Search ..... 345/48, 84, 85, 345/108, 148, 204; 348/755, 770; 349/24, 25

[56] References Cited

U.S. PATENT DOCUMENTS

| | | | |
|---|---|---|---|
| 5,278,652 | 1/1994 | Urbanus et al. . | |
| 5,497,172 | 3/1996 | Doherty et al. | 345/85 |
| 5,548,301 | 8/1996 | Kornher et al. | 345/85 |
| 5,619,228 | 4/1997 | Doherty | 345/148 |
| 5,673,060 | 9/1997 | Blaxtan et al. | 345/84 |
| 5,686,939 | 11/1997 | Millward et al. | 345/148 |
| 5,764,208 | 6/1998 | Burton et al. | 345/85 |

FOREIGN PATENT DOCUMENTS

| | | |
|---|---|---|
| 0 685 830 A1 | 12/1995 | European Pat. Off. . |
| WO 95/28696 | 10/1995 | WIPO . |

*Primary Examiner*—Mark R. Powell
*Assistant Examiner*—Vincent E. Kovalick
*Attorney, Agent, or Firm*—Charles A. Brill; Frederick J. Telecky, Jr.; Richard L. Donaldson

[57] ABSTRACT

A method of automatically generating a load/reset sequence for a display system having a spatial light modulator whose display elements that are loaded with data and reset between loads (FIG. 7). Bit-planes of data are classified according to their display times as normal, short, or reset-release (FIG. 5). Extra time of normal bit-planes is calculated (FIG. 5). The display times of normal bit-planes are adjusted by subtracting or adding extra time, such that any normal bit-plane displayed before a short or reset-release bit-plane includes sufficient extra time to allow for loading the short or reset-release bit-plane (FIG. 7). Also, reset conflicts are detected and avoided (FIGS. 7, 8, 9A and 9B).

18 Claims, 7 Drawing Sheets

GENERATING LOAD/RESET SEQUENCES FOR SPATIAL LIGHT MODULATOR

TECHNICAL FIELD OF THE INVENTION

This invention relates to digital image display systems using spatial light modulators (SLMs), and more particularly to generating a sequence of control signals for loading display elements of an SLM with data and resetting them between loads.

BACKGROUND OF THE INVENTION

Video display systems based on spatial light modulators (SLMs) are increasingly being used as an alternative to display systems using cathode ray tubes (CRTs). SLM systems provide high resolution displays without the bulk and power consumption of CRT systems.

Digital micro-mirror devices (DMDs) are a type of SLM, and may be used for either direct-view or projection display applications. A DMD has an array of micro-mechanical display elements, each having a tiny mirror that is individually addressable by an electronic signal. Depending on the state of its addressing signal, each mirror tilts so that it either does or does not reflect light to the image plane. The mirrors may be generally referred to as "display elements", which correspond to the pixels of the image that they generate. Generally, displaying pixel data is accomplished by loading memory cells connected to the display elements. After display element's memory cell is loaded, the display element is reset so that it tilts in the on or off position represented by the new data in the memory cell. The display elements can maintain their on or off state for controlled display times.

Other SLMs operate on similar principles, with an array of display elements that may emit or reflect light simultaneously, such that a complete image is generated by addressing display elements rather than by scanning a screen. Another example of an SLM is a liquid crystal display (LCD) having individually driven display elements.

To achieve intermediate levels of illumination, between white (on) and black (off), pulse-width modulation (PWM) techniques are used. The basic PWM scheme involves first determining the rate at which images are to be presented to the viewer. This establishes a frame rate and a corresponding frame period. For example, in a standard television system, images are transmitted at 30 frames per second, and each frame lasts for approximately 33.3 milliseconds. Then, the intensity resolution for each pixel is established. In a simple example, and assuming n bits of resolution, the frame time is divided into $2^n-1$ equal time slices. For a 33.3 millisecond frame period and n-bit intensity values, the time slice is $33.3/(2^n-1)$ milliseconds.

Having established these times, for each pixel of each frame, pixel intensities are quantized, such that black is 0 time slices, the intensity level represented by the LSB is 1 time slice, and maximum brightness is $2^n-1$ time slices. Each pixel's quantized intensity determines its on-time during a frame period. Thus, during a frame period, each pixel with a quantized value of more than 0 is on for the number of time slices that correspond to its intensity. The viewer's eye integrates the pixel brightness so that the image appears the same as if it were generated with analog levels of light.

For addressing SLMs, PWM calls for the data to be formatted into "bit-planes," each bit-plane corresponding to a bit weight of the intensity value. Thus, if each pixel's intensity is represented by an n-bit value, each frame of data has n bit-planes. Each bit-plane has a 0 or 1 value for each display element. In the simple PWM example described in the preceding paragraphs, during a frame, each bit-plane is separately loaded and the display elements are addressed according to their associated bit-plane values. For example, the bit-plane representing the LSBs of each pixel is displayed for 1 time slice, whereas the bit-plane representing the MSBs is displayed for 2n/2 time slices. Because a time slice is only $33.3/(2^n-1)$ milliseconds, the SLM must be capable of loading the LSB bit-plane within that time. The time for loading the LSB bit-plane is the "peak data rate."

U.S. Pat. No. 5,278,652, entitled "DMD Architecture and Timing for Use in a Pulse-Width Modulated Display System," assigned to Texas Instruments Incorporated describes pulse width modulation for addressing a DMD in a DMD-based display system. It is directed to "global reset" methods, where bit-plane data is loaded during the preceding display time of another bit-plane. To begin the display time, the display elements of the entire array are reset simultaneously.

Another method of SLM addressing is "divided reset" addressing. The display elements are divided into groups, but each display element has its own memory cell. After the memory cells of one group are loaded with their data from a bit-plane, memory cells of a next group are loaded with their data from that bit-plane. This continues until all groups have been loaded with data for the same bit-plane. This "phased" loading is followed by a phased reset so that all groups consecutively begin their display of the bit-plane. This method is described in U.S. patent application Ser. No. 08/721,862, entitled "Divided Reset for Addressing Spatial Light Modulator", assigned to Texas Instruments Incorporated.

SUMMARY OF THE INVENTION

One aspect of the invention is a method for automatically providing a load/reset sequence for a divided reset display system having a spatial light modulator, whose display elements are loaded with data and reset between loads. The data is formatted in bit-planes, each bit-plane to be displayed as one or more segments during a frame time. The spatial light modulator has certain timing parameters such as a minimum load time for loading all its display elements. A display order of the segments is stored. The segments are classified as having normal or short display times. Normal display times are at least as long as the minimum load time, and short display times are less than the minimum load time. The minimum load time is subtracted from each normal display time, thereby determining extra time for each normal display time. The frame time is divided into actual display times, such that each normal display time is given only the minimum load time. Then, enough extra time is added to any normal display time occurring before a short display time, so as to provide time to load the data for the short display time. Finally, any remaining extra time is distributed to the appropriate segment(s). Delay times are then assigned to each load and each reset, thereby generating the sequence.

An additional feature of the invention is identifying reset-release display times and providing the necessary loads, resets, and reset-releases in the sequence. Also, reset conflicts can be identified and avoided.

An advantage of the invention is that the process of generating load/reset sequences is automated. Features of the invention optimize the timing in terms of minimizing dark time and in terms of accommodating the maximum possible number of bit-plane divisions into segments. The process can generate sequences for divided or global reset sequences, or combine global and divided loads/resets in the same sequence.

DETAILED DESCRIPTION OF THE INVENTION

Overview of SLM Display Systems Using PWM

Comprehensive descriptions of SLM-based digital display systems are set out in U.S. Pat. No. 5,079,544, entitled "Standard Independent Digitized Video System," and in U.S. Pat. Ser. No. 08/147,249, entitled "Digital Television System," and in U.S. Pat. Ser. No. 08/146,385, entitled "DMD Display System." These systems are specifically designed for use with a digital micro-mirror device (DMD), which is a type of SLM. Each of these patents and patent applications is assigned to Texas Instruments Incorporated, and each is incorporated by reference herein. An overview of such systems is discussed below in connection with FIG. 1.

Figure 1:
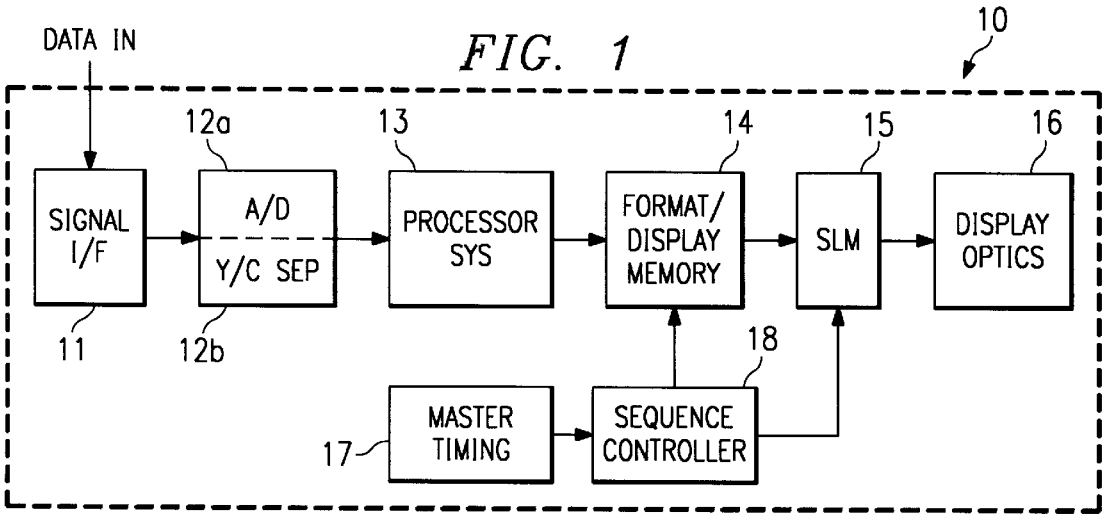
FIG. 1 is a block diagram of a projection display system that has a sequence controller programmed with a sequence generated in accordance with the invention.

FIG. 1 is a block diagram of a projection display system 10, which uses an SLM 15 to generate real-time images from an input signal, such as a broadcast television signal. In the example of this description, the input signal is analog, but in other embodiments, the input signal could be digital, eliminating the need for A/D converter 12*a*.

Only those components significant to main-screen pixel data processing are shown. Other components, such as might be used for processing synchronization and audio signals or secondary screen features, such as closed captioning, are not shown.

One aspect of the invention described herein is a method of generating timing sequences for addressing the SLM 15 of system 10. Each display element of the SLM 15 has a memory cell, which is loaded with one bit of data at a time. The one bit of data in memory for all display elements comprises a bit-plane. The instance of displaying a given bit-plane is referred to herein as a "segment", and a bit-plane may be displayed in one continuous segment or in multiple segments distributed throughout a frame.

After its memory cell is loaded, the display element is reset to the state represented by the data in the memory cell. This loading and resetting process occurs in a particular sequence of loads and resets. A sequence controller 18 is programmed with a sequence generated in accordance with the invention. It delivers control signals following this sequence to the frame memory 14 (for loading) and to the SLM 15 (for resetting).

In the example of this description, system 10 has a divided reset configuration. As explained below, the sequence generation process classifies segments according to the length of their initial display times. It then allocates actual display times so that segments having shorter display times can be loaded during a prior segment. The shortest of these short display times are treated as "reset-release" display times, which call for reset-releases in the sequence. It also prevents reset conflicts between reset sequences of any two or more groups.

Many of the same sequence generation concepts summarized in the preceding paragraph could be applied to a global reset system. In the case of a global reset system, the process would classify segments and provide for short and reset-release display times.

Signal interface unit 11 receives an analog video signal and separates video, synchronization, and audio signals. It delivers the video signal to A/D converter 12*a* and Y/C separator 12*b* , which convert the data into pixel-data samples and which separate the luminance ("Y") data from the chrominance ("C") data, respectively. In FIG. 1, the signal is converted to digital data before Y/C separation, but in other embodiments, Y/C separation could be performed before A/D conversion.

Processor system 13 prepares the data for display, by performing various pixel data processing tasks. Processor system 13 may include whatever processing memory is useful for such tasks, such as field and line buffers. The tasks performed by processor system 13 may include linearization (to compensate for gamma correction), colorspace conversion, and interlace to progressive scan conversion. The order in which these tasks are performed may vary.

Display memory 14 receives processed pixel data from processor system 13. It formats the data, on input or on output, into "bit-plane" format, and delivers the bit-planes to SLM 15. As discussed in the Background, the bit-plane format permits each display element of SLM 15 to be turned on or off in response to the value of one bit of data.

Display memory 14 is capable of providing bit-plane data to be displayed on whatever rows of the SLM are associated with a designated group. In accordance with divided reset addressing, it provides the bit-plane data for the series of groups that will display a first segment, then the bit-plane data for the groups that will display a next segment, etc.

In a typical display system 10, display memory 14 is a "double buffer" memory, which means that it has a capacity for at least two display frames. The buffer for one display frame can be read out to SLM 15 while the buffer for another display frame is being written. The two buffers are controlled in a "ping-pong" manner so that data is continuously available to SLM 15.

The bit-plane data from display memory 14 is delivered to SLM 15. Although this description is in terms of a DMD-type of SLM 15, other types of SLMs could be substituted into display system 10. As stated above, the invention assumes an SLM whose display elements are loaded with data and reset between loads. Details of a suitable SLM 15 are set out in U.S. Pat. No. 4,956,619, entitled "Spatial Light Modulator," which is assigned to Texas Instruments Incorporated and incorporated by reference herein.

Essentially, SLM 15 uses the data from display memory 14 to address each display element of its display element array. The front( or "off" state of each display element forms an image. In the embodiment of this invention, each display element of SLM 15 has an associated memory cell and is configured for "divided reset".

Display optics unit 16 has optical components for receiving the image from SLM 15 and for illuminating an image plane such as a display screen. For color displays, the display optics unit 16 includes a color wheel, to which a sequence of bit-planes for each color are synchronized. In an alternative embodiment, the bit-planes for different colors could be concurrently displayed on multiple SLMs and combined by the display optics unit.

Master timing unit 17 provides various system control functions.

Sequence controller 18 provides reset control signals to SLM 15 and load control signals to display memory 14. These signals are ordered in a sequence generated in accordance with the present invention. An example of a suitable sequence controller is described in U.S. patent application Ser. No. 08/975,377 (Atty Dkt No. TI-21545), entitled "Load/Reset Sequence Controller for Spatial Light Modulator", assigned to Texas Instruments Incorporated and incorporated herein by reference.

Divided Reset Addressing

Figure 2:
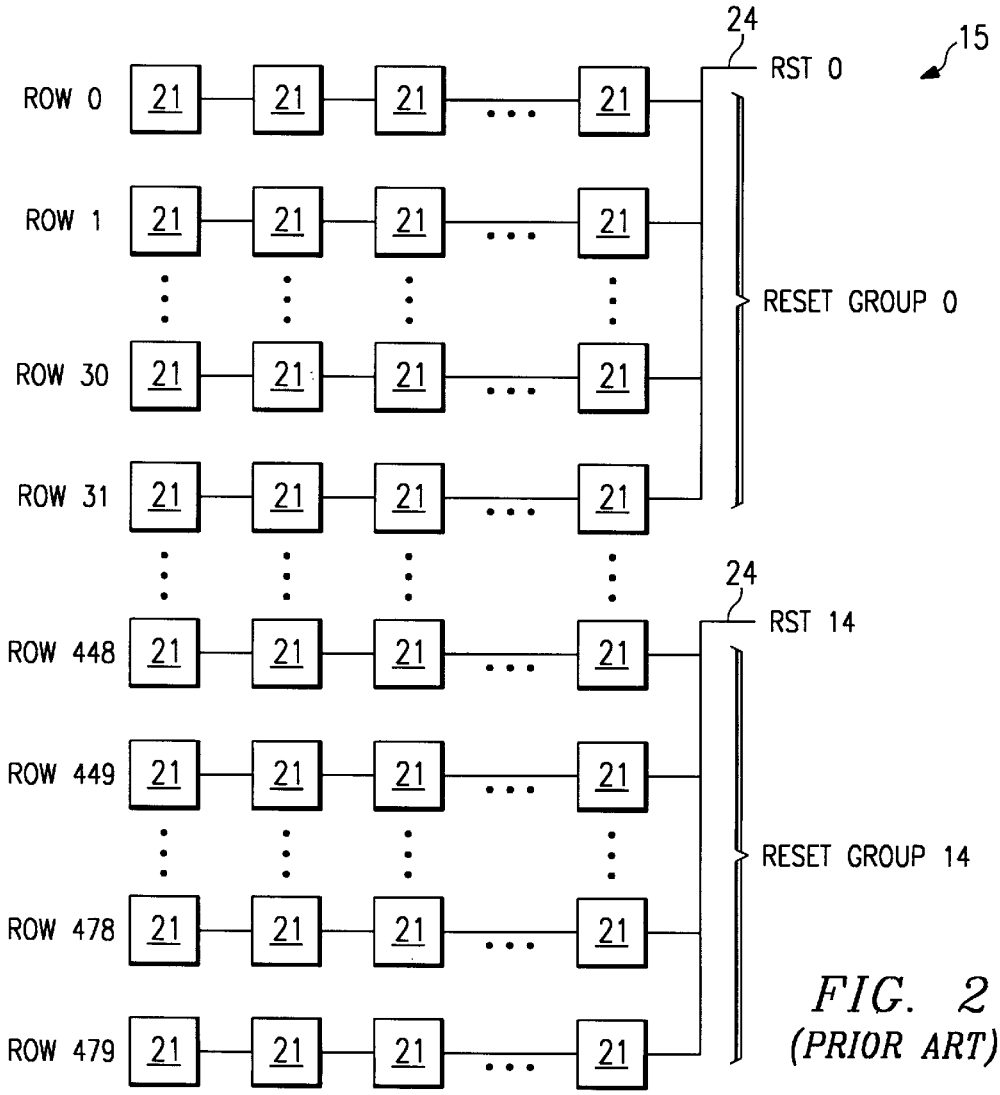
FIG. 2 (PRIOR ART)
FIG. 2 illustrates a portion of the display element array of the SLM of FIG. 1, configured for divided reset addressing.

FIG. 2 illustrates a portion of the display element array of SLM 15, configured for divided reset addressing. As explained below, addressing the display elements 21 requires that each display element's memory cell be loaded with data and that it be reset between loads. The display elements display the data by being on or off for a designated display time.

Only a small number of display elements 21 are explicitly shown, but as indicated, SLM 15 has additional rows and columns of display elements 21. A typical SLM 15 has hundreds or thousands of such display elements 21. As stated above, each display element 21 has a memory cell, so that there are as many memory cells as display elements 21.

SLM 15 is divided into "groups" of display elements 21, which are defined by which display elements 21 are connected to a single reset line 24. In the example of FIG. 2, each 32 consecutive rows of display elements 21 are connected to a single reset line 24, and thus these 32 rows of display elements are a group. If a 480-row SLM 15 has 32 rows per group, there are 15 groups.

The number of groups into which SLM 15 is arranged is somewhat arbitrary. In general, the minimum bit-plane display time is inversely proportional to the number of groups. On one hand, shorter bit times are desirable because they allow better flexibility for mitigating visual artifacts. On the other hand, overall complexity of the display system 10 increases with more groups because of the need for additional drive circuits, package pins, and control circuitry. In general, however, the principles described herein apply to a SLM 15 having any number of groups more than one.

The rows of each group need not be consecutive. Any pattern is possible, such as an interleaved pattern of every nth row for n reset lines. The pattern could be in vertical or diagonal rows. Furthermore, the pattern need not be row-by-row, and could be in blocks, contiguous or interleaved. However, experimentation indicates that visual artifacts are minimized for groups consisting of consecutive horizontal rows.

The bit-plane data for the groups is formatted into group data. Thus, where p is the number of active display elements of the SLM 15 and q is the number of groups, a bit-plane having p number of bits is formatted into q groups of data, each group having p/q bits of data.

Figure 3:
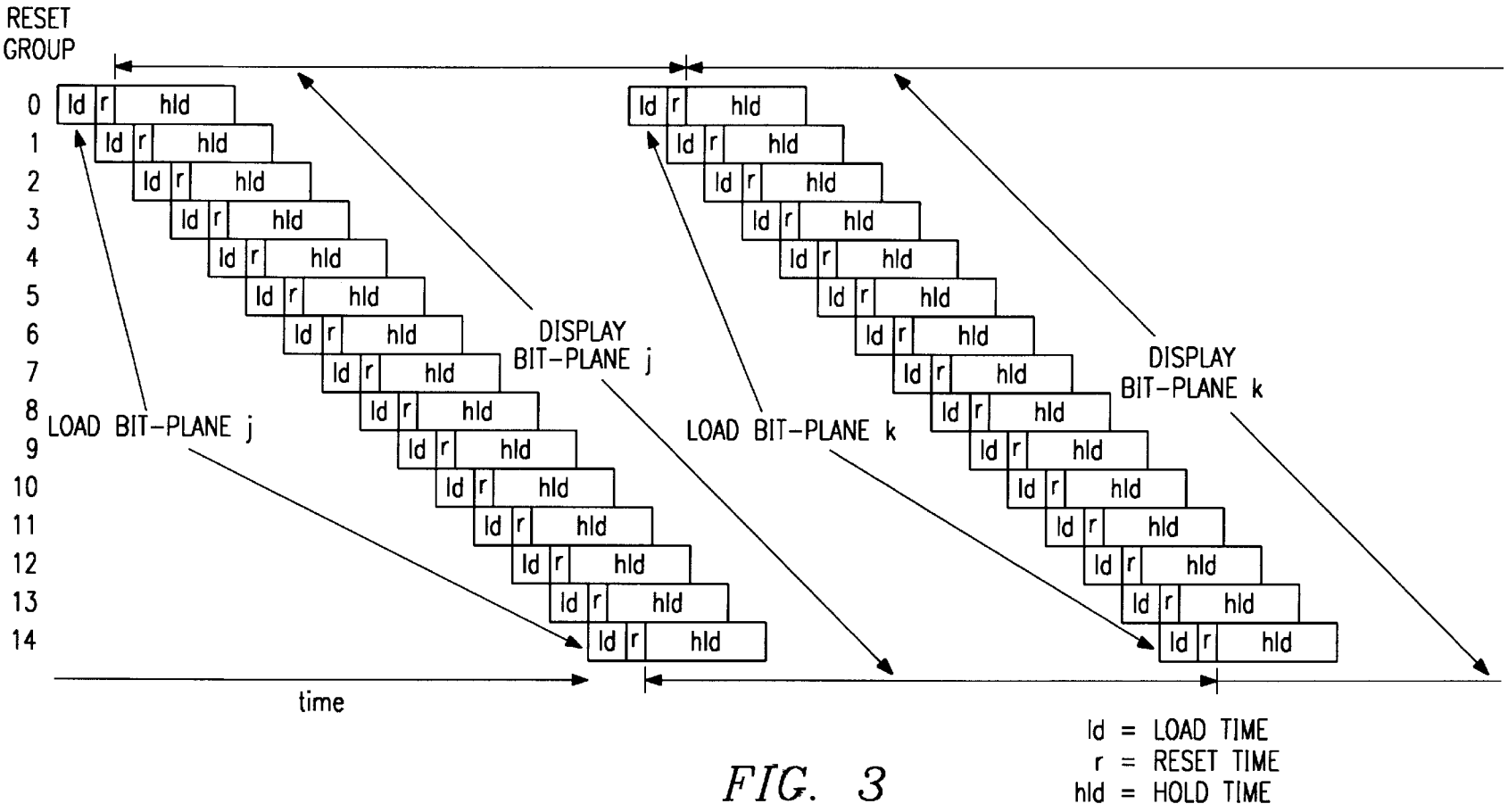
FIG. 3 (PRIOR ART)
FIG. 3 illustrates the phased loads and resets in a divided reset system.

FIG. 3 illustrates how the 15 groups of FIG. 2 are loaded and reset for display of a bit-plane j. Each group is first loaded with data, during a load time, ld. Then, the display elements of this group are reset. The reset time, r, represents the time when a reset signal is applied on the reset line connected to that group. The reset signal causes each mirror in the group to change state in accordance with the data stored in its memory cell. After being reset, the group begins its display time. At the beginning of the display time, the display elements undergo a "hold" time, hld, during which the data must be stable.

As soon as one group is loaded, loading of the next group may begin. This loading, resetting, and displaying process is repeated for each of the 15 groups, such that after each group is loaded, the loading of the next group begins while the previous group is being reset and displayed.

In FIG. 3, the load and reset for each group occurs consecutively, resulting in a "phased reset". The display times of the groups for the bit-plane are skewed at the beginning and end of the display time. However, the viewer perceives the display elements' "on" time nearly the same as if all display elements were on simultaneously for the bit time.

In FIG. 3, the reset of each group occurs immediately after loading of that group. As a result, the display time is as long as the total time to load all groups. This is a "nominal display time". In the particular example of FIG. 3, the display time for bit-plane j, is the same as the time to load all groups—from the reset of Group 0 to the reset of Group 14. The display time can be made longer by delaying the loading for the next bit-plane.

Figure 3A:
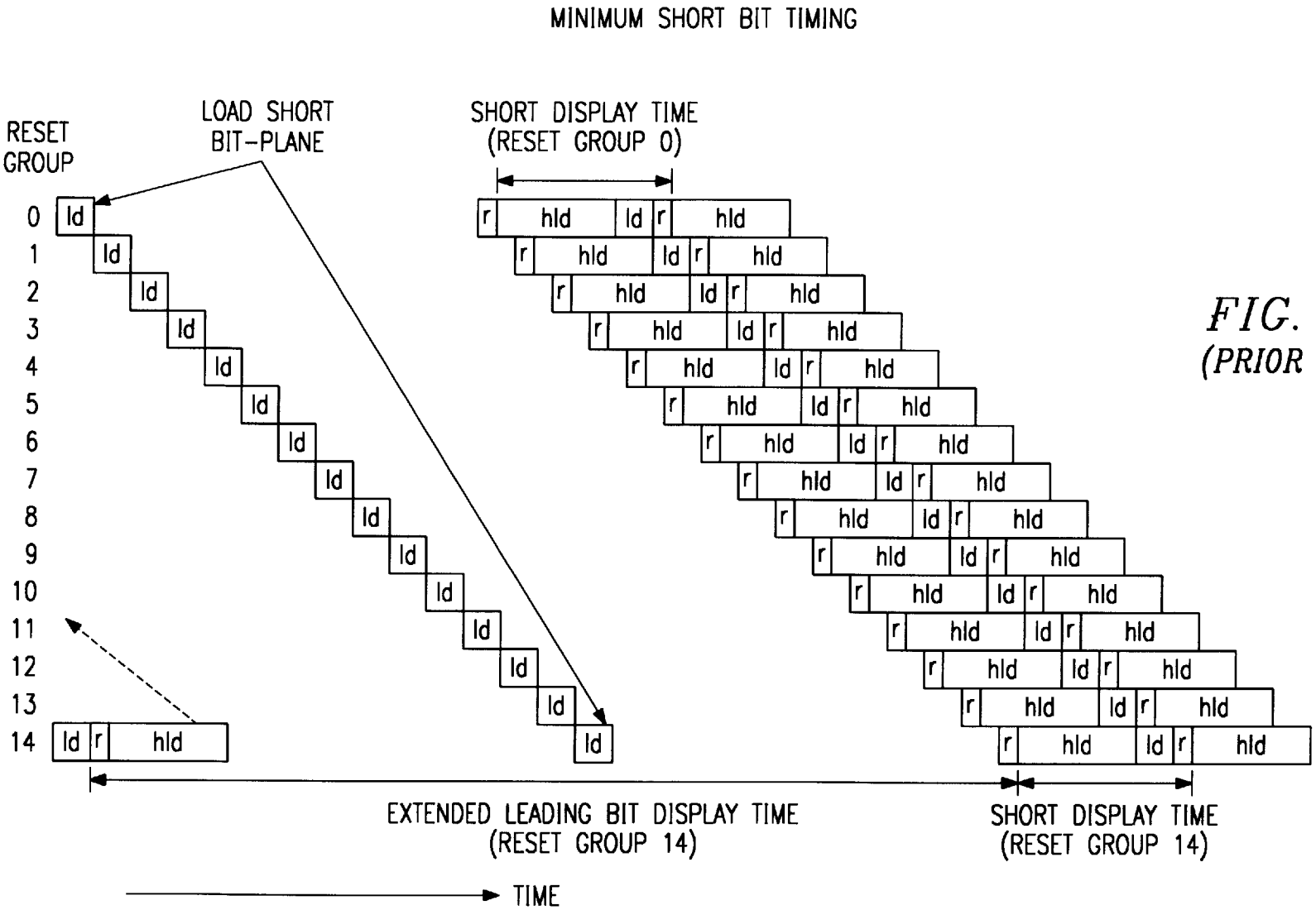
FIG. 3A (PRIOR ART)
FIG. 3A illustrated the loads and resets for a short display time.

FIG. 3A illustrates how display times shorter than the nominal display time can be accomplished. For shorter display times, the resets can be delayed with respect to the loads.

Also, the time between load and reset need not be the same among groups. This makes it possible to align the resets rather than skew them at the beginning of a bit-plane display time.

Variations of divided reset addressing, such as those discussed in the preceding paragraphs, are discussed in U.S. patent application Ser. No. 08/721,862, referenced above and incorporated by reference herein.

Load/Reset Sequence Generation

As stated above, sequence controller 18 is programmed with a sequence of loads and reset instructions. The "sequence" is the particular order, for a frame period, of loads and resets for all groups. For example, relative to time 0, a portion of a reset sequence might include the following two instructions:

reset [170,1]

reset [16,2]

where the argument is [delay, group number]. A portion of a load sequence might include the following two instructions:

load [300,5]

load [198,6]

where the argument is [delay, bit-plane number]. Usually, a load of a bit-plane occurs without interruption for all groups. When this is the case, no group designations are necessary, it being implied that a load instruction is for a continuous series of all groups. However, as explained below, there may be situations when the loads of groups for a bit-plane are independently initiated.

The reset sequence and the load sequence are coordinated with each other so that loads and resets occur at the proper times. In the above examples of reset and load sequences, the delays are from a common reference.

The sequence programmed into sequence controller 18 is the result of a sequence generation process that is the subject of this invention. This sequence generation process is performed by a computer programmed as described below. A computer so programmed is referred to herein as a "sequence generator", and may be a general purpose or a dedicated computer.

Figure 4:
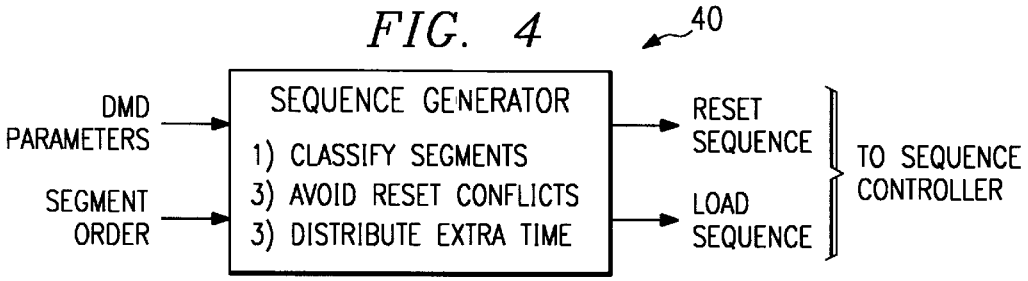
FIG. 4 illustrates a sequence generator in accordance with the invention.

FIG. 4 illustrates a sequence generator 40 in accordance with the invention. It receives various "DMD parameters" and a "segment order". These terms are defined herein. Sequence generator 40 generates a sequence of resets and loads and their relative timing. As explained below in connection with FIG. 7, the functions of sequence generator 40 include classifying segments, preventing "reset overlaps", and distributing "extra time" of certain segments.

The "DMD parameters" represent various constraints and dynamics of SLM 15 that affect resets and loads. These DMD parameters determine the "classification" of the segment to be reset or loaded.

Figure 5:
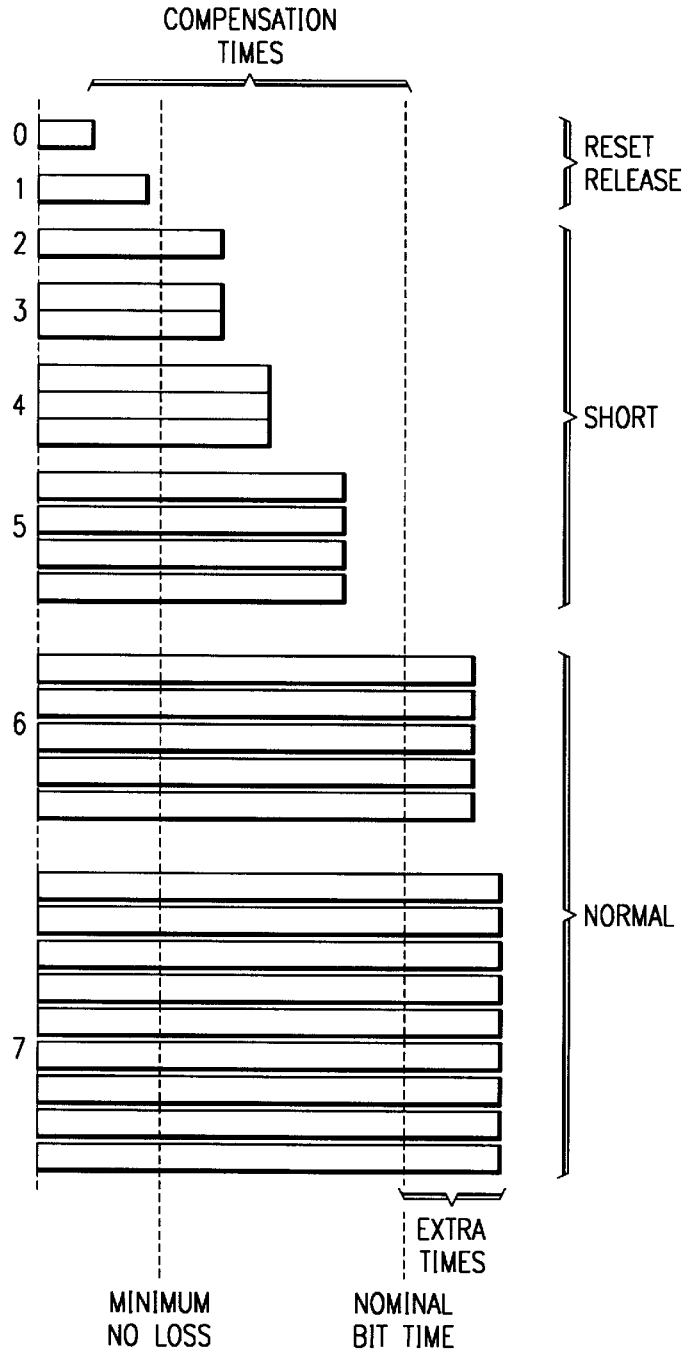
FIG. 5 illustrates bit-planes, their segmentation, and their classification.

FIG. 5 illustrates bit-plane segments for 8-bit pixel values, as well as their classification. As discussed above, a bit-plane is displayed as one or more segments. When a bit-plane has multiple segments, its display time is divided and distributed within the frame period. Typically, the bit-plane(s) of one or more of the more significant bits are segmented. If a bit-plane has multiple segments, typically the segments are equal in length and have the same type, but this is not necessarily the case. In FIG. 5, bit-planes 3–7 have multiple segments.

Classification is based on the initial display times of segments, that is the display time that a segment would have in the absence of reallocation in accordance with the invention. There are three classes of segments (corresponding to three classes of display times): normal, short, and reset release. Nominal display times are as long or longer than a "nominal" display time. Referring again to FIG. 3, a nominal display time is equal to the time required to load the SLM when all groups are loaded sequentially, one immediately after the other. This permits the loading of a segment into all the groups while the previously loaded segment is being displayed on all groups. Short and reset-release display times are shorter than the nominal display time.

As illustrated by FIG. 3A, short display times can be achieved by delaying the resets with respect to the loads of that segment. If resets are delayed until the end of the hold time meets the start of the next load, the short display time can be as short as the sum of the reset time, hold time, group load time, and data setup time.

Reset-release display times are shorter than the sum of the reset time, hold time, group load time, and data setup time. A reset-release display time is terminated with a reset-release pulse so that the display elements "float". During this float time, the next bit-plane is loaded before the bias is re-applied. The use of reset-release display times in a global reset system is described in U.S. patent application Ser. No. 08/736,169 (Atty Dkt No. TI-20604), entitled "Improved Reset Scheme for Spatial Light Modulators", assigned to Texas Instruments Incorporated and incorporated herein by reference.

In FIG. 5, the segments of bit-plane 7 (the MSB) and bit-plane 6 are "normal" segments. The segments of bit-planes 5, 4, 3, and 2 are "short" segments. The segments of bit-planes 1 and 0 are "reset-release" segments.

The following table lists various DMD parameters used by sequence generator 40.

| parameter | description |
|---|---|
| reset time | time for a normal reset sequence |
| reset | time for a reset sequence |
| release time | without associated bias on |
| bias on time | time to activate the bias |
| data hold time | time after initiation of bias-on after which a load is allowed |
| reset release hold time | time between reset release and bias-on |
| mirror transit time | time used to allow for transition of a mirror |
| data setup time | required time after a load completes after which a reset operation may be initiated |
| clear time | required time to globally clear device |
| group load time | time required to load a group |
| minimum r to r time | minimum time between two reset operations |
| frame time | total time to be taken by all bit-planes of the sequence |
| used frame time | total time that light will be perceived during a frame |
| number of reset groups | number of groups into which the device is divided |
| number of color wheel sections | |
| section time | time to be taken by each color wheel section |

The above parameters are for a system 10 with a color wheel that may have more than one section per color. Each color has a "frame time" that is a portion of the total time for one revolution of the color wheel. Each color has a sequence for each of its color wheel sections.

Figure 6A:
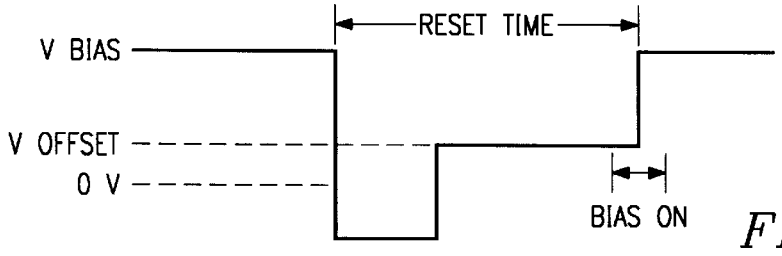
FIGS. 6A and 6B illustrate several of input parameters of FIG. 4.
Figure 6B:
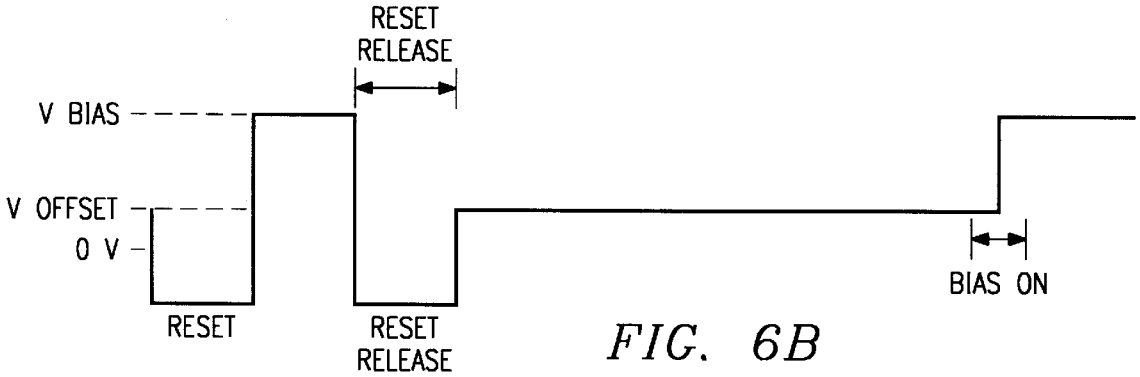

FIGS. 6A and 6B illustrate several of the reset timing parameters listed in the above table. The "reset time" is for normal and short segments, which are reset with a normal reset signal comprised of a pulse, an offset voltage, and a return to bias voltage. The "reset release time" is for reset release segments, for which the offset voltage time is extended. The "bias on time" is the time to return the mirror to a bias voltage. The "data hold time" is illustrated in FIG. 3. For reset release segments, there is also a reset release hold time after the reset release signal. The "mirror transit time" represents light loss while display elements are changing state. This value is determined experimentally to ensure that desired intensity levels are perceived. The "data setup time" is the time during which the data must be stable before a reset can begin. A "clear" is a method of setting all memory cells to zero so that they will be all off after a global reset. The "minimum reset to reset time" is a constraint of sequence controller 18, which can perform a next reset this amount of time after a prior reset.

Referring again to FIG. 4, specifically to the input data to sequence generator 40, the "segment order" is the order in which segments are to be loaded (and therefore displayed) during a frame. A bit-plane having multiple segments is loaded multiple times. As explained above in connection with FIG. 1, frame memory 14 delivers each bit-plane as data for the series of groups of the SLM's display elements. It might deliver a segment of the MSB, then a segment of the MSB-2, then the segment for the LSB, then another segment of the MSB, etc, until all segments for all bit-planes are loaded. Typically, each frame repeats the same segment order.

Figure 7:
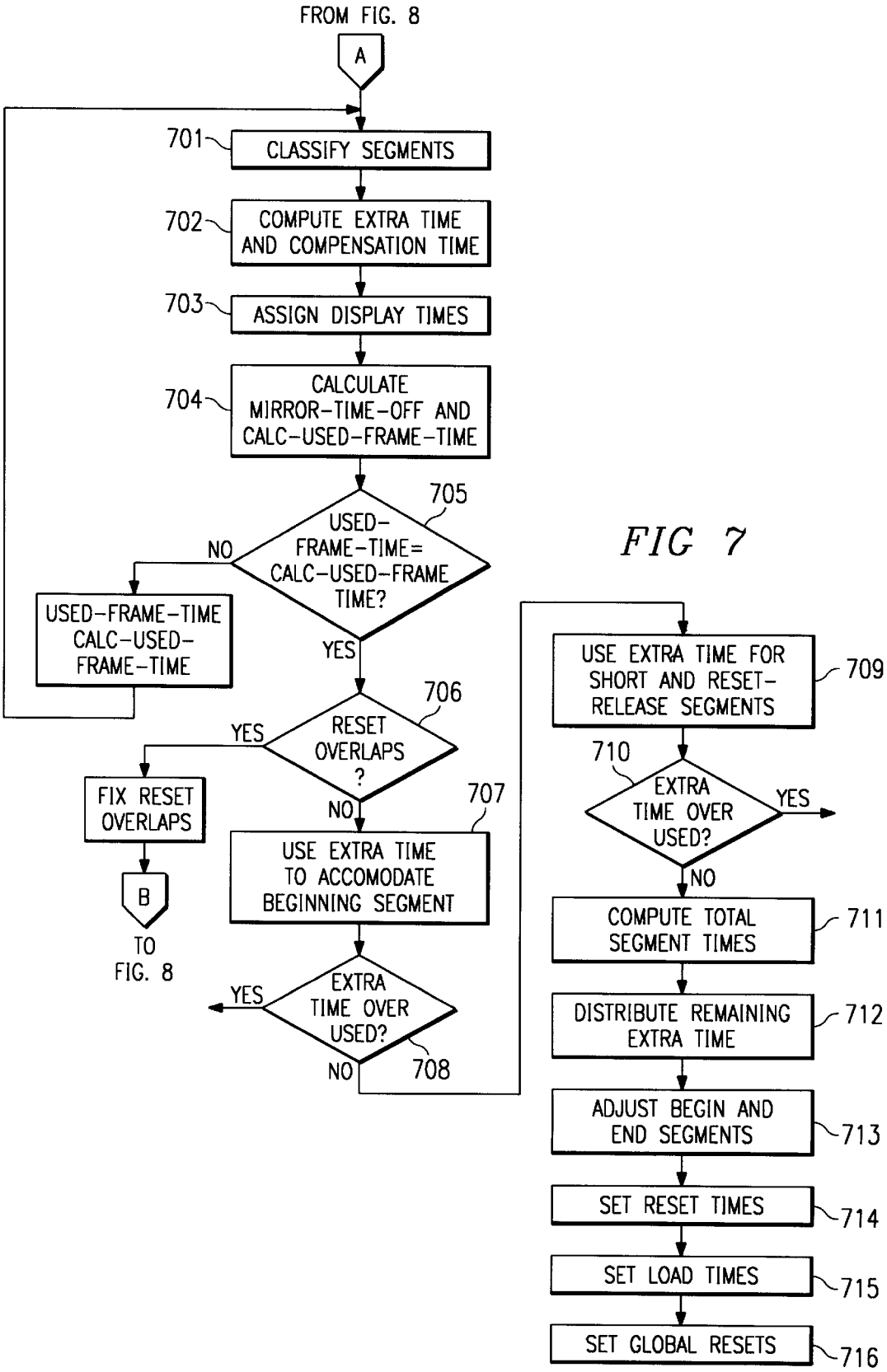
FIG. 7 illustrates the process performed by the sequence generator of FIG. 4.

FIG. 7 illustrates the process performed by sequence generator 40 to provide a sequence that meets the constraints of the DMD parameters.

In Step 701, the segments are classified as normal, short, or reset-release. A different data structure is set up to describe each segment.

In Step 702, extra times and compensation times are computed for each segment. Referring again to FIG. 5, "extra time" is time beyond the nominal display time. "Compensation time" is the time that would be required to make a segment have a nominal display time. In the example of FIG. 5, the segments of bit-planes 6 and 7 have extra time and the other segments need compensation time.

Step 703 is assigning an actual display time to each segment. These display times are calculated from the input parameter, used frame time, which is divided according to the number of bit-planes and their weights. At this point in the process, normal segments are only given their nominal display time.

Step 704 is calculating a mirror-time-off value for the frame. This calculation includes dark times resulting from mirror transit, reset-release, and global clears. The mirror-time-off value is subtracted from the frame time to determine a calculated used frame time.

In Step 705, the calculated used frame time is compared to the used frame time that was input as a parameter. If they are equal, the process continues. If they are not equal, the used frame time is set equal to the calculated used frame time and Steps 701–705 are repeated. This ensures that dark times for reset release bits are properly accounted for when the used frame time is divided into initial times.

In Step 706, a check is made for reset conflicts. This occurs when reset signals in any two or more groups overlap in time. For example, for short segments, where resets are delayed, the resets for the next segment could begin before all the resets of the short segment are finished. This could result in one or more overlaps between resets of the two segments, occurring in different groups. The existence of one or more overlaps is a "reset conflict". Potential reset conflicts can be determined by calculations based on the segment display times and the reset times.

Figure 8:
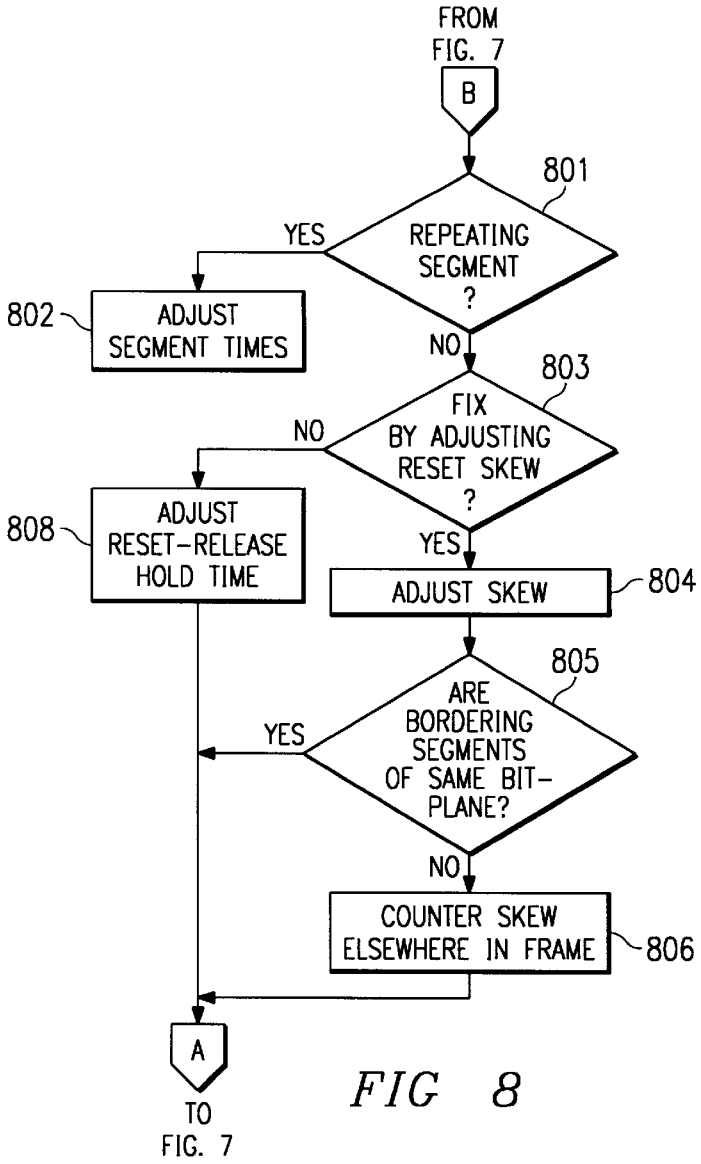
FIG. 8 illustrates the process for fixing reset overlaps.

FIG. 8 illustrates the process for fixing a reset conflict. If a reset conflict has occurred, Step 801 is determining if the bit-plane of the short or reset release segment involved in the conflict has multiple segments. If so, the reset conflict is a "repeating segment" conflict. In Step 802, this conflict is avoided by adjusting segment display times of the same bit-plane. Specifically, the segment in which the overlap occurred can be shortened (or lengthened) and another segment of the same bit-plane can be lengthened (or shortened) to compensate. With this compensation, the total display time for the bit-plane is not affected.

If the reset conflict is not a repeating segment conflict, Step 803 is determining if the conflict can be avoided by adjusting the skew of the reset timing (the "reset skew"). This fix is possible if the reset conflict is during a short segment. If the fix is possible, in Step 804, the reset skew is adjusted. Normally, the reset skew conforms to a load skew for continuous loading from group to group, one immediately after the other. Thus, if the reset skew is adjusted, it is made more horizontal, i.e., with more time between each reset.

Figure 9A:
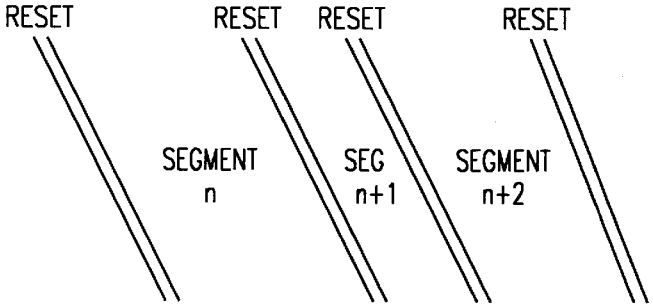
FIGS. 9A and 9B illustrate how reset overlaps are fixed by adjusting the reset skew.
Figure 9B:
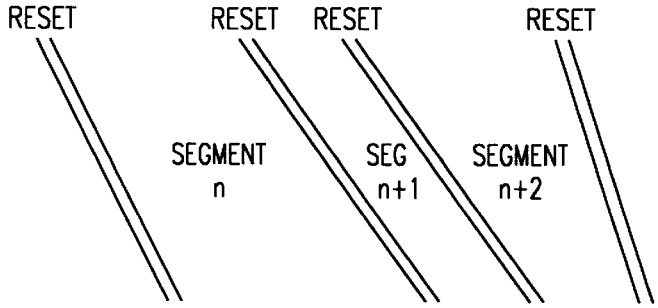

FIGS. 9A and 9B illustrate Steps 803 and 804. In FIG. 9A, segment n+1 is a short segment and has reset overlaps with segment n+2. In FIG. 9B, the overlaps have been corrected by changing the reset skew of both segments. However, as a result, segment n has increased display times for some of its groups as does segment n+2. If segments n and n+2 are segments of the same bit-plane, this does not affect the viewer's perception of the image. However, if they are not segments of the same bit-plane, a "counterskew" must be placed somewhere else in the frame. This is accomplished by locating a segment of bit-plane n+2 preceding a segment of bit-plane n and skewing any boundary(ies) between them. That is, their boundary is skewed if they are adjacent, and if there are intervening segments, all boundaries between them are skewed.

If the reset skew is adjusted as a result of Step 804, the load skew for each affected bit-planes is also changed. When a load skew is made more horizontal (with more time between each load) it may be necessary to intersperse loads of that bit-plane with resets of the next bit-plane. The process of FIG. 7 tracks the loads and resets and provides a sequence with group loads rather than a continuous load for the bit-plane.

Step 806 applies if there are reset overlaps in a reset-release bit-plane. In this case, the reset-release hold time is adjusted.

Figure 10:
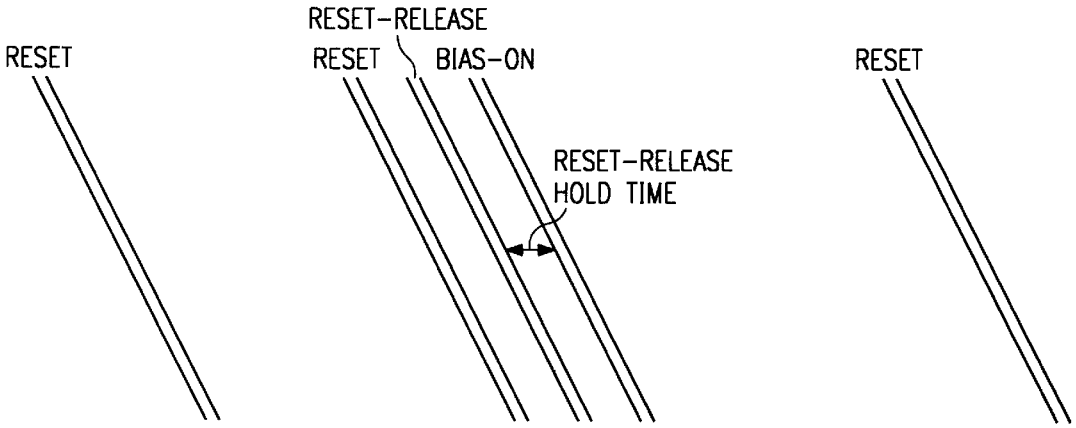
FIG. 10 illustrates how reset overlaps are fixed for reset release bit-planes.

FIG. 10 illustrates Step 806. As illustrated, the reset-release hold time is the time between the reset-release signal and the bias on. This time can be adjusted to prevent reset overlaps involving the bias on.

Referring again to FIG. 7, Step 707 is using extra time to accommodate the beginning segment of the frame. More specifically, at the beginning of a frame, the first segment is loaded during a dark time then all groups are globally reset. A data hold time follows the global reset. This data hold time is compensated with extra time.

In Step 708, it is determined whether the extra time is used up. If so, the process declares a "no solution" condition and terminates.

In Step 709, remaining extra time is used to accommodate short and reset-release segments. For example, assume a segment of bit-plane 7 is to precede the segment for bit-plane 4 and that the segment for bit-plane 4 has a compensation time of x. In this situation, x time would be taken from the extra time of bit-plane 7 and added to the display time of that segment.

In Step 710, it is determined whether the extra time is used up. If so, the process declares a "no solution" condition and terminates.

Step 711 applies if the color wheel has more than one wheel section per color. As stated above, in a color wheel display system, the process of FIG. 7 is repeated for each color. Each color may have more than one wheel section, in which case, the process generates a sequence for each wheel section. In Step 711, the total time used for the combined wheel sections, including any extra time added in previous steps, is calculated.

Step 712 is distributing remaining extra time. If the color wheel has only one section, the extra time is evenly distributed between the segment. If the color wheel has more than one wheel section, the extra time is distributed in such a manner as to ensure that each wheel section acquires its proper share of display time. The target times for each wheel section are input to sequence generator 40 as a DMD parameter.

Step 713 is adjusting the beginning and ending bit-planes to establish the skew of the resets and loads. As stated above, at the beginning of a frame, a global reset begins the display time of all groups of the first segment simultaneously. For each group in this first segment, the display time is made progressively longer, consistent with the load skew for the remaining segments in the frame. The last segment of the phased portion of the sequence is the "last phased segment". This segment ends with a global reset, after which any number of global segments may be displayed. The last phased segment is from the same bit-plane as the first segment. The last phased segment has display times that are progressively shorter for each group. This results in the proper overall display time for the corresponding bit-plane.

Steps 714 and 715 are calculating the delays for the loads and resets based upon the segment display times. As stated above, for loads, normally a segment is continuously loaded to all groups. Thus, load instructions are accomplished by identifying that segment's associated bit-plane. The exception is when a reset skew is adjusted, in which case load instructions identify the bit-plane and group. Step 714 includes setting the delays for reset releases and bias on for reset release segments.

Step 716 is setting any global resets. In a color wheel display system, a "clear" is used at the end of each wheel section (at "spokes" of the color wheel). This provides a dark time as the spoke passes. Because of the need for this dark time, a short or reset-release segment is often placed as the last segment in a sequence. This also avoids extra time being required for the short or reset release segment. In the case of a reset release segment, this also eliminates an additional dark time (during the mirror "float") that would be required if the reset release bit were placed elsewhere in the frame. In Step 716, the global reset delays for all global resets are calculated.

The above description of the process of FIG. 7 was directed to a divided reset display system. Many of the same concepts apply to a global reset system. In a global reset system, all segments are loaded during the previous segment's display time and then globally reset. Thus, the problem is being able to provide a short display time but still having sufficient time to load the next segment. In a manner analogous to classification for divided reset systems, segments for global reset systems are classified as normal, short, or reset-release, as determined by their display times. A normal display time is as long or longer than a nominal display time, e.g., the sum of the hold time, the time to load all display elements, the reset time, and the data setup time. Short display times are shorter than the nominal display time. Short display times are followed by clearing the data and loading the next bit-plane during a dark time. A short display time can be as short as the sum of the hold time, the clear time, the reset time, and data setup time. Reset-release display times are terminated with a reset-release so that the clear can begin while the display elements are in a "float" state, after which the loading of the data for the next segment occurs during a dark time.

Other Embodiments

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A method for automatically providing a load/reset sequence for a divided reset display system having a divided reset spatial light modulator, whose display elements are addressed with data by means of loads and resets, said data being formatted in bit-planes, each bit-plane to be loaded as one or more segments during a frame time, and said spatial light modulator having a minimum load time, comprising the steps of:

storing a display order of said segments;

classifying each of said segments as having a normal display time or a short display time, said normal display time being at least as long as said minimum load time, and said short display time being less than said minimum load time;

subtracting said minimum load time from each said normal display time, thereby determining extra time for each said normal display time;

assigning an actual display time to each of said segments, such that each normal display time is given only said minimum load time;

adding at least part of said extra time to any said normal display time occurring before one of said short display times;

distributing any remaining extra time; and setting a start time for each said load and reset of each of said segments.

2. The method of claim 1, further comprising the step of classifying at least one of said segments as having a reset-release display time.

3. The method of claim 2, wherein said setting step further comprises setting a start time for one or more reset release signals.

4. The method of claim 2, further comprising the step of placing one of said segments having a reset-release display time at the end of said frame time.

5. The method of claim 1, further comprising the step of globally resetting said display elements to begin said display time of at least one of said segments.

6. The method of claim 1, further comprising the step of calculating a used frame time representing the total display time and comparing said used frame time with a desired frame time.

7. The method of claim 1, wherein said adding step is performed by adding an amount of extra time sufficient to compensate the difference between said short display time and said minimum display time.

8. The method of claim 1, wherein said display elements have a hold time and a load time and wherein said short display time is at least as long as said reset time plus said hold time.

9. A method for automatically providing a load/reset sequence for a display system having a global reset spatial light modulator, whose display elements are addressed with data by means of loads and resets, said data being formatted in bit-planes, each bit-plane to be loaded as one or more segments during a frame time, and said spatial light modulator having a minimum load time, comprising the steps of:

storing a display order of said segments;

classifying each of said segments as having a normal display time or a short display time, said normal display time being at least as long as said minimum load time, and said short display time being less than said minimum load time;

dividing said frame time into said display times;

placing a clear after each said segment having a short display time; and setting a start time for each said load, reset, and clear of each of said segments.

10. The method of claim 9, further comprising the step of classifying at least one of said segments as having reset-release display time.

11. The method of claim 10, wherein said setting step further comprises setting a start time for one or more reset release signals.

12. The method of claim 9, further comprising the step of calculating a used frame time representing the total display time and comparing said used frame time with a desired frame time.

13. The method of claim 12, wherein said short display times are at least as long as said hold time plus time for said clear.

14. The method of claim 9, wherein said display elements have a hold time and wherein said normal display time is at least as long as said hold time plus said minimum load time.

15. A method for automatically providing a load/reset sequence for a display system having a divided reset spatial light modulator, whose display elements are addressed with data by means of loads and resets, said data being formatted in bit-planes, each bit-plane to be loaded as one or more segments during a frame time, and said spatial light modulator having a minimum load time, comprising the steps of:

storing a display order of said segments;

determining whether resetting of any said segment results in a reset conflict with the resetting of a next said segment, thereby identifying a conflicting segment;

determining whether said conflicting segment is of a bit-plane having multiple segments; and if said conflicting segment is of a bit-plane having multiple segments, avoiding said reset conflict by adjusting said display time of said conflicting segment and counter adjusting another segment of the associated bit-plane; and setting start times for each load and reset of each said segment.

16. The method of claim 15, further comprising the step of avoiding said reset conflict by adjusting the reset skews of said conflicting segment and of said next said segment, if said conflicting segment is not of a bit-plane having multiple segments.

17. The method of claim 15, further comprising the step of determining whether said conflicting segment is bordered by segments of the same bit-plane and, if not, counter adjusting reset skews elsewhere during said frame time.

18. The method of claim 15, wherein said conflicting segment has a reset-release display time, such that said segment is terminated with a reset release signal, and wherein said step of avoiding said reset conflict is accomplished by adjusting the hold time of said conflicting segment.

* * * * *

UNITED STATES PATENT AND TRADEMARK OFFICE

CERTIFICATE OF CORRECTION

PATENT NO. : 6,008,785

DATED : December 28, 1999

INVENTOR(S) : Gregory J. Hewlett, et. al.

It is certified that error appears in the above-indentified patent and that said Letters Patent is hereby corrected as shown below:

Cover Page, insert Item [60] under Related U.S. Application Data

--Provisional Application No. 60/031,804 Nov. 28, 1996.--

Signed and Sealed this

Twentieth Day of March, 2001

Nicholas P. Godici

*Attest:*

NICHOLAS P. GODICI

*Attesting Officer*

*Acting Director of the United States Patent and Trademark Office*